US009236689B2

(12) United States Patent
Goh et al.

(10) Patent No.: US 9,236,689 B2
(45) Date of Patent: Jan. 12, 2016

(54) ELECTRICAL CONNECTOR

(71) Applicant: Molex Incorporated, Lisle, IL (US)

(72) Inventors: Siow-Pheng Goh, Singapore (SG); Yoke-Wai Cheah, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/100,194

(22) Filed: Dec. 9, 2013

(65) Prior Publication Data

US 2014/0162499 A1 Jun. 12, 2014

(30) Foreign Application Priority Data

Dec. 11, 2012 (CN) ..... 2012 1 0532110

(51) Int. Cl.
*H01R 13/6461* (2011.01)
*H01R 12/71* (2011.01)
*H01R 13/6471* (2011.01)
*H01R 13/646* (2011.01)

(52) U.S. Cl.
CPC ..... *H01R 13/6461* (2013.01); *H01R 12/716* (2013.01); *H01R 13/646* (2013.01); *H01R 13/6471* (2013.01)

(58) Field of Classification Search
CPC .. H01R 12/7222; H01R 12/51; H01R 13/646; H01R 13/516; H01R 23/722
USPC ..... 439/82, 660, 637, 892, 76.1, 629, 626, 439/630, 59, 260, 267, 325, 377
See application file for complete search history.

(56) References Cited

U.S. PATENT DOCUMENTS

| | | | | |
|---|---|---|---|---|
| 5,795,191 | A * | 8/1998 | Preputnick et al. | 439/607.11 |
| 7,481,657 | B2 * | 1/2009 | Ng et al. | 439/78 |
| 2003/0162446 | A1 | 8/2003 | Ho et al. | |
| 2012/0108109 | A1 * | 5/2012 | Zhang et al. | 439/629 |
| 2012/0238145 | A1 * | 9/2012 | Zhang et al. | 439/660 |

* cited by examiner

*Primary Examiner* — James Harvey
*Assistant Examiner* — Oscar C Jimenez
(74) *Attorney, Agent, or Firm* — Stephen L. Sheldon

(57) ABSTRACT

An electrical connector comprises a body and a plurality of terminals. The body may comprise a slot, a one side wall, a plurality of spacers and a plurality of terminal grooves. The side wall is adjacent to the slot, the plurality of spacers are positioned on the side wall and arranged alongside the slot. The plurality of terminal grooves are adjacent to the side wall, the each spacer is positioned between the adjacent two terminal grooves. The plurality of terminals comprise two pairs of differential signal terminals and a ground terminal, the ground terminal is positioned between the two pairs of differential signal terminals. The two pairs of differential signal terminals and the ground terminal are received in the corresponding terminal grooves. The spacer between the each pair of differential signal terminals and the ground terminal can be partially removed.

4 Claims, 9 Drawing Sheets

ELECTRICAL CONNECTOR

RELATED APPLICATIONS

This application claims priority to Chinese Application No. 201210532110.3, filed Dec. 11, 2012, which is incorporated herein by reference in its entirety.

TECHNICAL FIELD

The present disclosure relates to an electrical connector.

BACKGROUND ART

An electrical connector is used to connect two different electronic devices. Typically, the electrical connector comprises a body, formed of an insulative material, and a plurality of terminals, the plurality of terminals are arranged at a preset interval and fixed on the body. When the electrical connector is designed, there are many factors to be considered, one of the factors is signal integrity. However, as the terminals are arranged at a smaller interval and the electrical connector is applied in high frequency transmission, a problem of crosstalk interference between the terminals appears; and the crosstalk interference will seriously affect the signal integrity.

FIG. 1 illustrates an existing Serial attached SCSI (SAS) connector 1, which is disclosed in a Chinese patent application No. 200580028544.8. Referring to FIG. 1, the SAS connector 1 comprises a housing 11 and a plurality of terminals 12. The housing 11 has a side wall 111, the side wall 111 has a central portion 1111 and the terminals 12 are arranged at the central portion 1111. In order to reduce the crosstalk interference, a portion of the housing from an outer side to an inner side of an upper half part of the central portion 1111 and extending into a part of the terminal groove side wall is removed, thereby reducing the material between the terminals 12. However, the method removing the material from the outer side of the side wall 111 to the inner side will damage the integrity of the outer side of the side wall 111, make the part of the side wall 111 become thinner and the configuration of the side wall 111 become fragile, thereby making the housing 11 easily damaged.

Furthermore, dust or dirt from the outer environment are easily get into the SAS connector 1 from the side wall 111 where the dielectric material is removed, if the dust or dirt falls into a gap between the terminal 12 and a groove wall of the terminal groove, it may make the terminal 12 blocked and may cause it to be difficult to inserting an electronic card. Moreover, the exposed terminal 12 is easily affected by the dust or dirt, which can result in poor electrical contact. The exposed terminal 12 can also easily cause a short circuit of the SAS connector 1 due to contact with a conductor. Moreover, the exposed terminal 12 itself can also be hit which can result in a deformation and damage.

SUMMARY OF THE INVENTION

An embodiment of the present disclosure provides an electrical connector, which comprises a body and a plurality of terminals. The body may comprise a slot, at least one side wall, a plurality of spacers and a plurality of terminal grooves. The side wall is adjacent to the slot. The plurality of spacers are positioned on the side wall and arranged alongside the slot. The plurality of terminal grooves are adjacent to the side wall, the each spacer is positioned between the adjacent two terminal grooves. The plurality of terminals comprise two pairs of differential signal terminals and a first ground terminal, the first ground terminal is positioned between the two pairs of differential signal terminals. The two pairs of differential signal terminals and the first ground terminal are received in the corresponding terminal grooves. The spacer between the each pair of differential signal terminals and the first ground terminal is at least partially removed.

DETAILED DESCRIPTION OF THE PREFERRED EMBODIMENTS

Hereinafter embodiments of the present disclosure will be described in details in combination with the drawings. As can be appreciated, an electrical connector design is disclosed. Benefits of the new design include the fact that since the spacer between the each pair of differential signal terminals and the first ground terminal is at least partially removed, capacitance between the each pair of differential signal terminals and the first ground terminal may be reduced, therefore transmission quality of a high frequency signal may be maintained.

Figure 1:
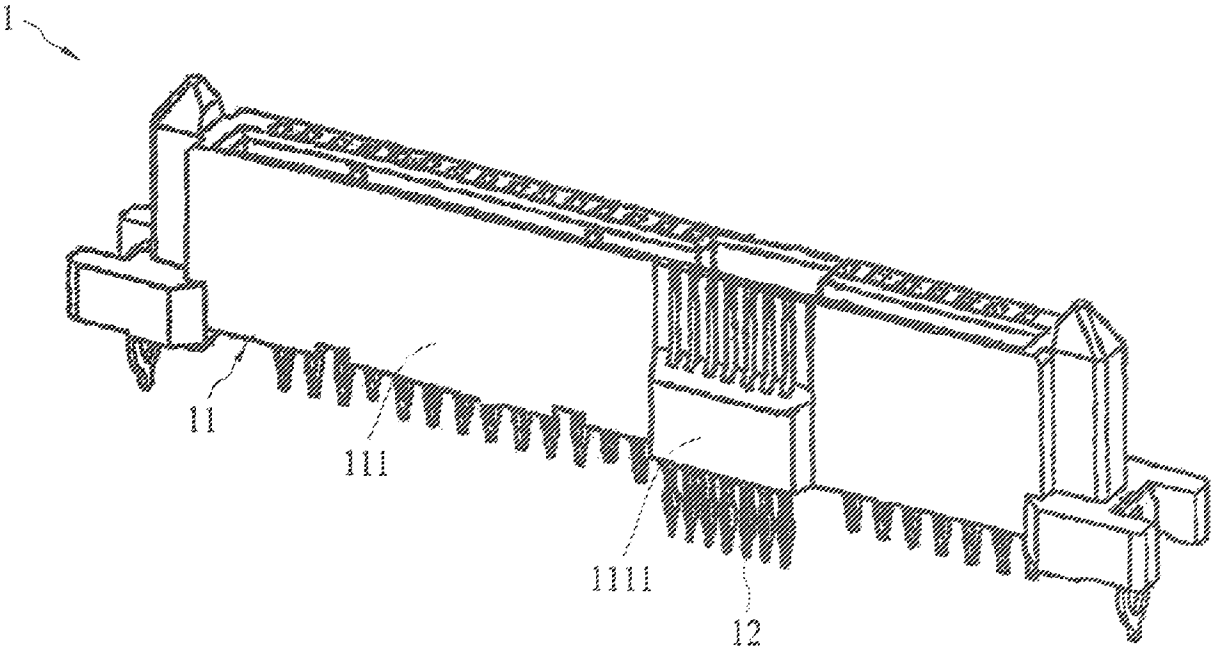
FIG. 1 (Prior Art)
FIG. 1 illustrates an existing SAS connector.
Figure 2:
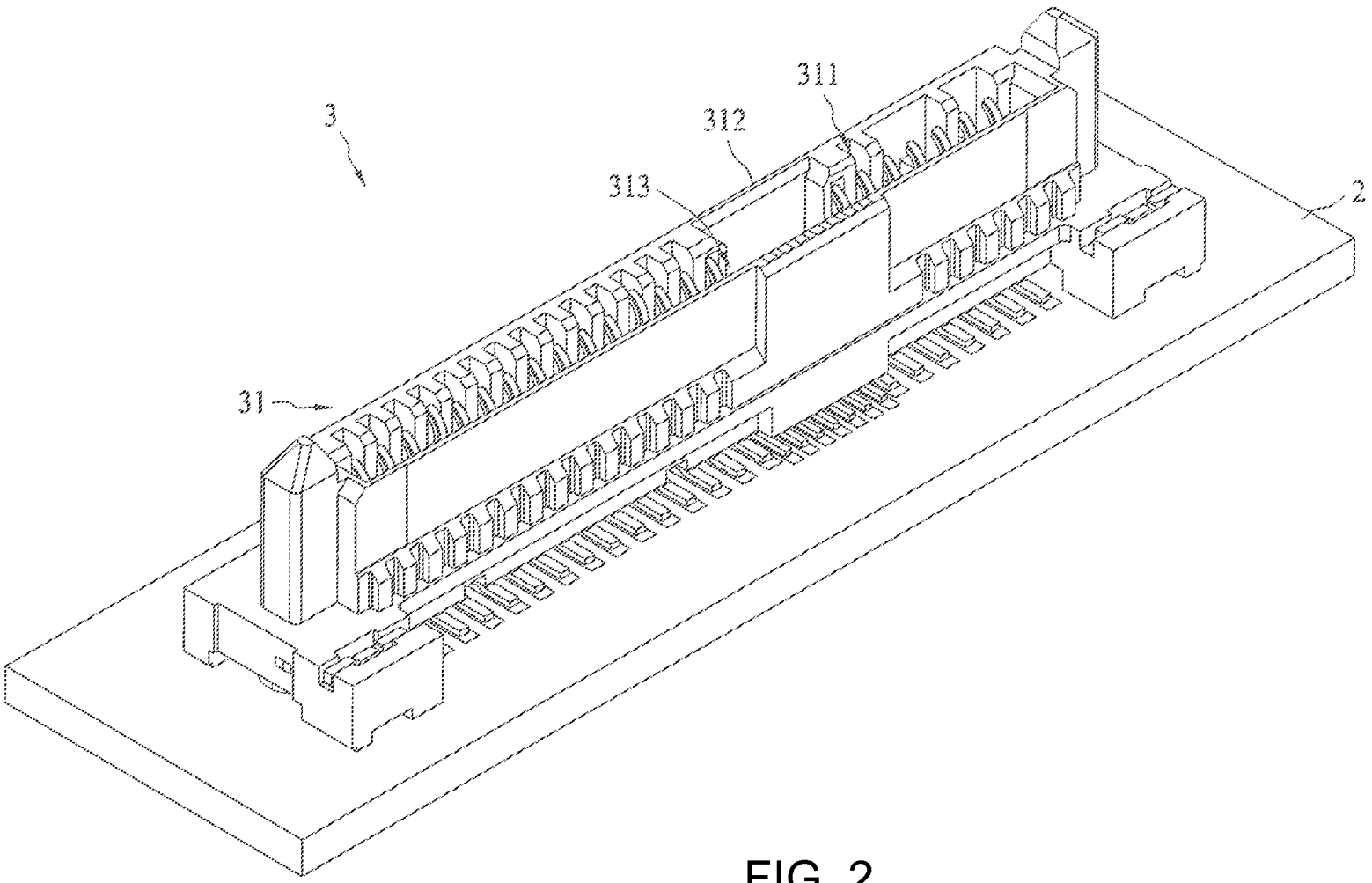
FIG. 2 is a perspective view of an embodiment of an electrical connector mounted on a circuit board.
Figure 3:
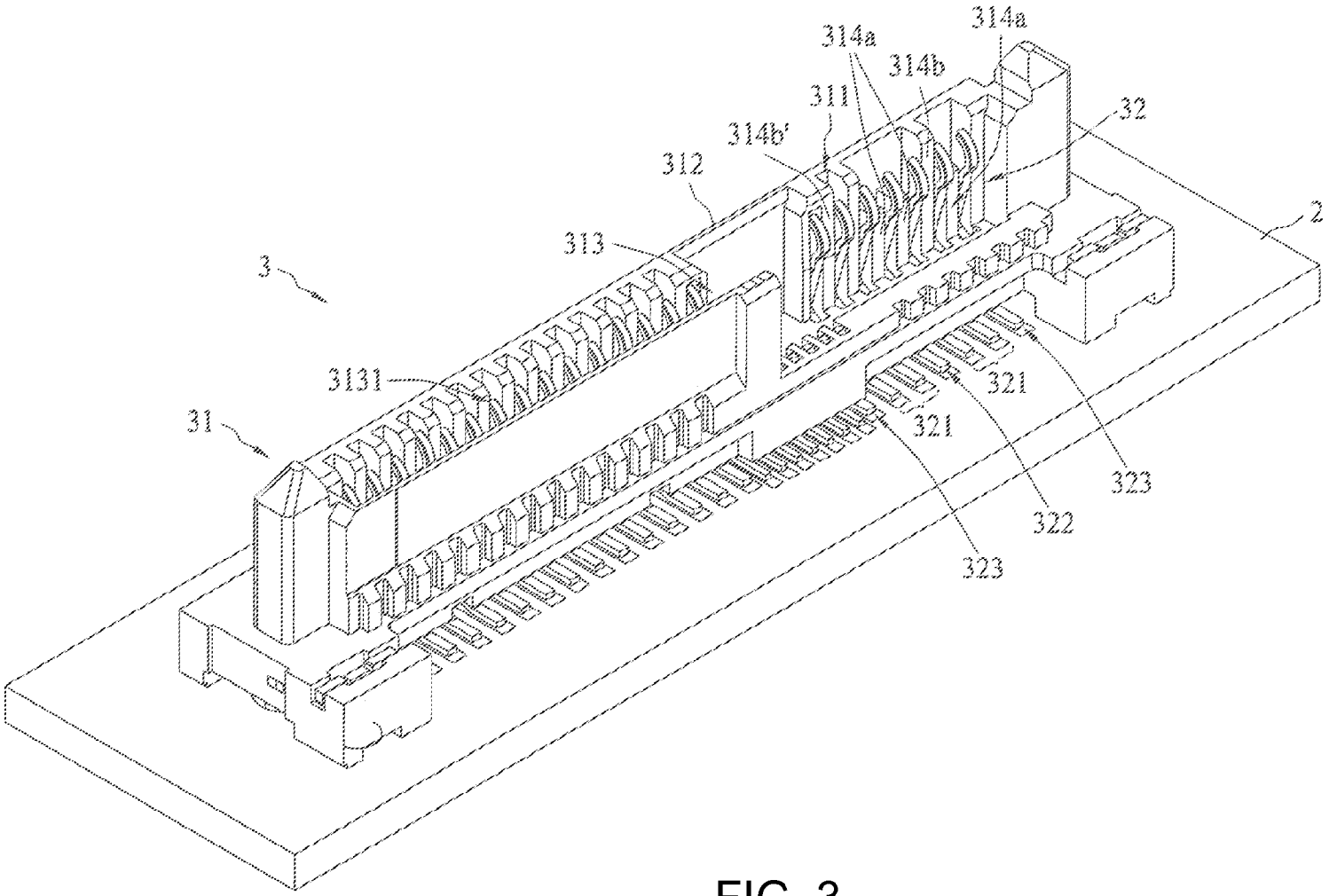
FIG. 3 is a partial cut away perspective view the embodiment depicted in FIG. 2, illustrating a spacer on a side wall of a body.
Figure 4:
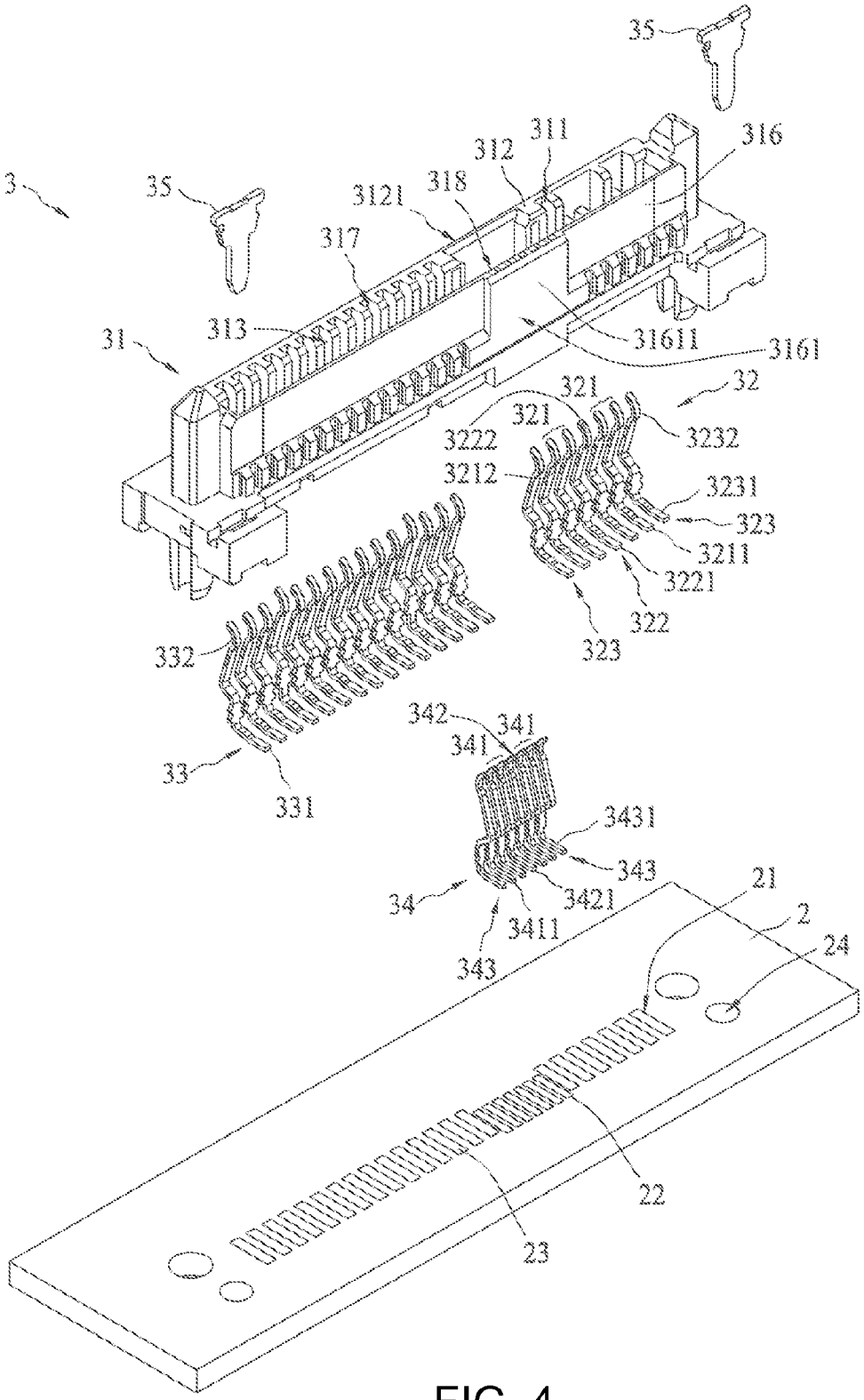
FIG. 4 is an exploded perspective view of an embodiment of an electrical connector.

FIG. 2 is a perspective view of an electrical connector 3 of an embodiment of the present disclosure mounted on a circuit board 2. FIG. 3 is a partial cut away perspective view of the embodiment of the present disclosure illustrating a spacer on a side wall of a body 31, the body 31 can be formed of an insulative material. FIG. 4 is an exploded perspective view of the electrical connector 3 of the embodiment of the present disclosure.

In an embodiment, the electrical connector 3 may comprise at least one group of terminals. Referring to FIG. 2 and FIG. 3, the electrical connector 3 may be provided on a circuit board 2. The electrical connector 3 may comprise a body 31 and a plurality of terminals 32. The body 31 is formed with a plurality of terminal grooves 311, and the plurality of terminals 32 are received in the corresponding terminal grooves 311.

In an embodiment, the body 31 may be rectangular, but the present disclosure is not limited to that. The body 31 comprises a side wall 312 and a slot 313. A plurality of terminal grooves 311 are adjacent to the side wall 312. The side wall 312 may be adjacent to the slot 313, the slot 313 is used for inserting an electronic card. The slot 313 may have an insertion port 3131. The insertion port 3131 may face upwardly, and the electronic card may face downwardly through the insertion port 3131 to insert into the slot 313.

Referring to FIG. 4, the plurality of terminals 32 may comprise two pairs of differential signal terminals 321 and a first ground terminal 322, the first ground terminal 322 is positioned between the two pairs of differential signal terminals 321. The body 31 may comprise a plurality of spacers (314*a* and 314*b*). The spacers (314*a* and 314*b*) may be positioned on the side wall 312 and arranged alongside the slot 313 with an interval to form the terminal grooves 311. In other words, each spacer (314*a* or 314*b*) is positioned between the two adjacent terminal grooves 311.

Figure 5:
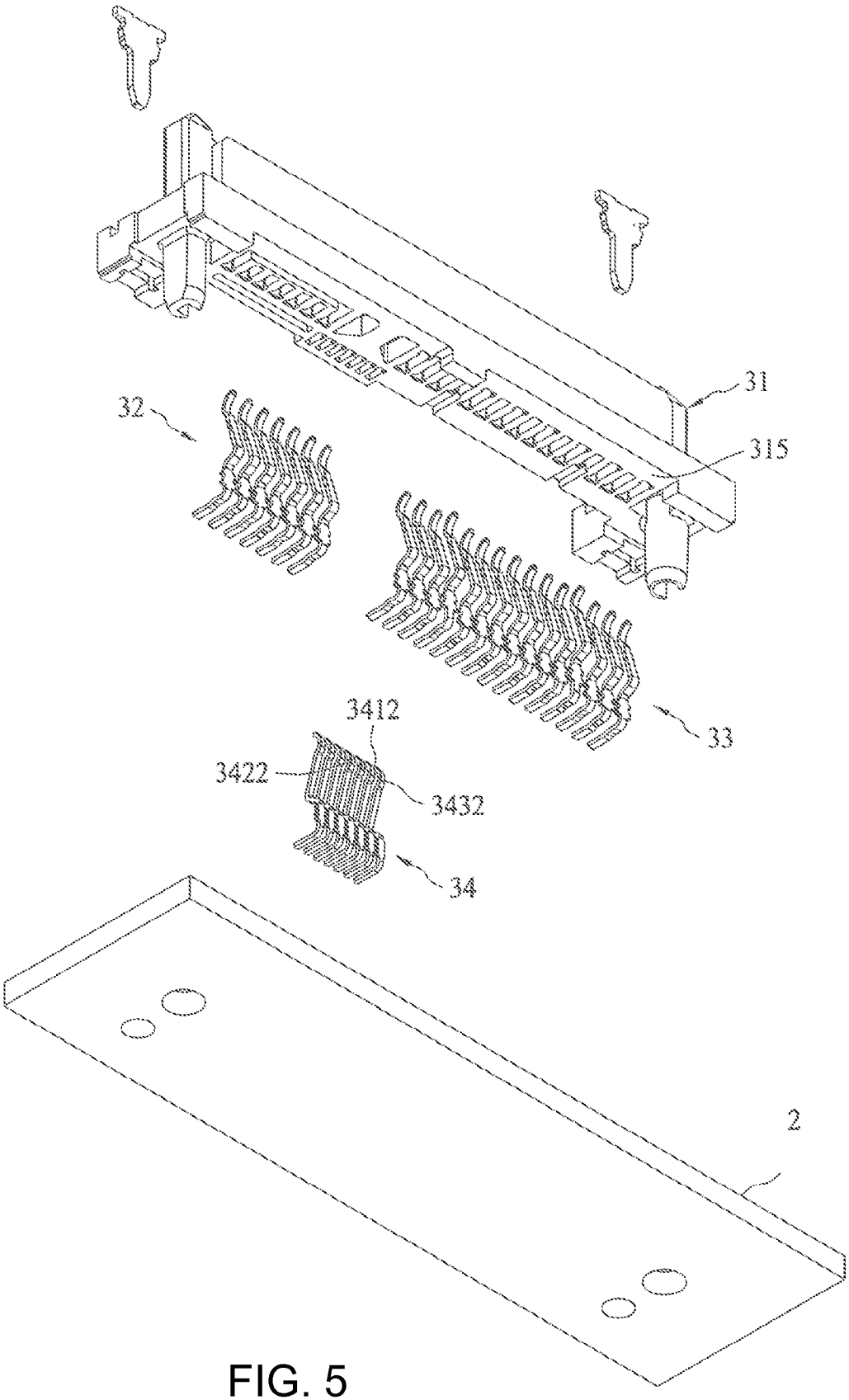
FIG. 5 is another perspective view of the embodiment depicted in FIG. 4.

FIG. 5 is an exploded perspective view of the embodiment of the present disclosure illustrating the electrical connector 3 viewed from a lower side. Referring to FIG. 3 and FIG. 5, the spacer (for example the spacer 314*b*) may generally extend downwardly from the insertion port 3131 of the slot 313 to a bottom 315 of the body 31. The spacer 314*b* may extend to the bottom 315 of the body 31 or may be close to the bottom 315 of the body 31. In order to reduce crosstalk interference, the spacer 314*a* which is positioned between the each pair of differential signal terminals 321 and the first ground terminal 322 is at least partially removed so as to reduce the dielectric material between the each pair of differential signal terminals 321 and the first ground terminal 322 and to reduce the dielectric constant between the each pair of differential signal terminals 321 and the first ground terminal 322, thereby reducing capacitance between each pair of differential signal terminals 321 and the first ground terminal 322 and maintaining transmission quality of a high frequency signal.

Again referring to FIG. 3, the plurality of terminals 32 may further comprise two second ground terminals 323. The two second ground terminals 323 are respectively positioned at two outer sides of the two pairs of differential signal terminals 321, and are respectively adjacent to the two pairs of differential signal terminals 321. The body 31 comprises spacers (314*a* and 314*b*') which separate the each second ground terminal 323 and the adjacent corresponding pair of differential signal terminals 321, the spacer 314*a* between the at least one second ground terminal 323 and the corresponding pair of differential signal terminals 321 is at least partially removed. In an embodiment, the each second ground terminal 323 and the corresponding pair of differential signal terminals 321 are separated by the spacer 314 which is at least partially removed.

Compared with the general spacer 314*b*, the spacer 314*a* is at least partially removed. In an embodiment, after the spacer 314*a* is at least partially removed to allow the electronic card to insert into the electrical connector 3, partial sections of the two terminals which are adjacent to the spacer 314*a* are separated by air, the partial sections may be any sections of the two terminals, and are not limited to sections which comprise terminal end. As shown in FIG. 3, in an embodiment, the spacer 314*a* at least partially removed is removed a part of the spacer 314*a* which is adjacent to the insertion port 3131 of the slot 313. In another embodiment, the spacer 314*a* at least partially removed is removed an upper half part of the spacer 314*a*. In another embodiment, a height of the spacer 314*a*, which is in the slot 313, is not more than a half height of the spacer 314*b*, which is in the slot 313.

Referring to FIG. 4, each terminal 32 may comprise a soldering portion (3211, 3221 or 3231), and the circuit board 2 may be provided with a corresponding soldering pad 21, each terminal 32 may be bent so that the soldering portion (3211, 3221 or 3231) may extend outside the bottom 315 of the body 31 essentially parallel to a board surface of the circuit board 2, thus the soldering portion (3211, 3221 or 3231) may be soldered on the corresponding soldering pad 21 by a surface mount technology. In an embodiment, the circuit board 2 comprise a plurality of soldering vias, the soldering portion of each terminal 32 may penetrate into the corresponding soldering via. In an embodiment, the circuit board 2 comprises a plurality of through-holes, the soldering portion of each terminal 32 comprises a needle eye and the needle eye and the corresponding soldering through-hole are configured for an interference fit. Each terminal 32 may comprise a contact portion (3212, 3222 or 3232), the contact portion (3212, 3222 or 3232) may protrude into the slot 313.

In an embodiment, the electrical connector 3 may comprise a plurality of groups of terminals. Referring to FIG. 4, the following side wall 312 of the body 31 is referred to as a second side wall 312, the terminal groove 311 is referred to as a first terminal groove 311, and the terminal 32 is referred to as a first terminal 32. The body 31 may further comprise a first side wall 316, the slot 313 is positioned between the second side wall 312 and the first side wall 316. The second side wall 312 of the body 31 may comprise a recessed portion 3121 and a plurality of second terminal grooves 317, the recessed portion 3121 separates the first terminal grooves 311 and the second terminal grooves 317. The recessed portion 3121 may be formed alongside the slot 313. In an embodiment, the recessed portion 3121 may be used to prevent a mating connector from being incorrectly inserted.

The electrical connector 3 comprises a plurality of second terminals 33, the plurality of second terminals 33 are respectively received in the second terminal grooves 317. The first terminals 32 may connect signal lines or ground lines of the circuit board 2, and the second terminals 33 may connect power lines of the circuit board 2.

The electrical connector 3 may comprise a plurality of third terminals 34, and the body 31 may comprise a plurality of third terminal grooves 318, the third terminals 34 are correspondingly received in the third terminal grooves 318. The plurality of third terminals 34 may connect signal lines or ground lines of the circuit board 2. In an embodiment, the plurality of third terminals 34 may comprise two pairs of differential signal terminals 341 and a first ground terminal 342, the first ground terminal 342 is positioned between the two pairs of differential signal terminals 341. In an embodiment, the plurality of third terminals 34 may comprise two second ground terminals 343, the two second ground terminals 343 may be respectively provided at two outer sides of the two pairs of differential signal terminals 341.

In an embodiment, the spacer between the first ground terminal 342 and the each pair of differential signal terminals 341 may be partially removed. In an embodiment, the spacer between the each pair of differential signal terminals 341 and the adjacent second ground terminal 343 may be partially removed. In an embodiment, the spacer between at least one pair of differential signal terminals 341 and the adjacent second ground terminal 343 may be partially removed.

The first side wall 316 of the body 31 may comprise a section 3161, the section 3161 comprises an outer protruding portion 31611, the plurality of third terminal grooves 318 are formed in the section 3161. In an embodiment, an arranged interval between the plurality of third terminals 34 may be the same as the arranged interval between the plurality of first terminals 32. In an embodiment, the arranged interval between the plurality of third terminals 34 may be different from the arranged interval between the plurality of first terminals 32. In an embodiment, the arranged interval between the plurality of third terminals 34 may smaller than the arranged interval between the plurality of first terminals 32.

Each of the second terminals 33 and the third terminals 34 may comprise a soldering portion (331, 3411, 3421 or 3431), and the circuit board 2 may be provided with a corresponding soldering pad (22 or 23), the second terminal 33 and the third terminal 34 are bent so shat the soldering portion (331, 3411, 3421 or 3431) may extends outside the bottom 315 of the body 3*l* essentially parallel to the board surface of the circuit board 2, thus the soldering portion (331, 3411, 3421 or 3431) may be soldered on the corresponding soldering pad (22 or 23) by the surface mount technology. In an embodiment, the circuit board 2 comprises a plurality of soldering vias, the soldering portion of each of the second terminals 33 and the third terminals 34 may insert into the corresponding soldering via. In an embodiment, the circuit board 2 comprises a plurality of through-holes, the soldering portion of each of the second terminals 33 and the third terminals 34 comprises a needle eye and the needle eye and the corresponding through-hole are configured for an interference fit.

Referring to FIG. 4 and FIG. 5, each of the second terminal 33 and the third terminal 34 may comprise a contact portion (332, 3412, 3422 or 3432), the contact portion (3412, 3422 or 3432) may protrude into the slot 313. Referring to FIG. 4, the electrical connector 3 may comprise a plurality of fixed pieces 35. The fixed piece 35 may be fixed on the body 31 and may be soldered to an aperture 24 of the circuit board 2, so as to fix the electrical connector 3 on the circuit board 2.

Figure 6:
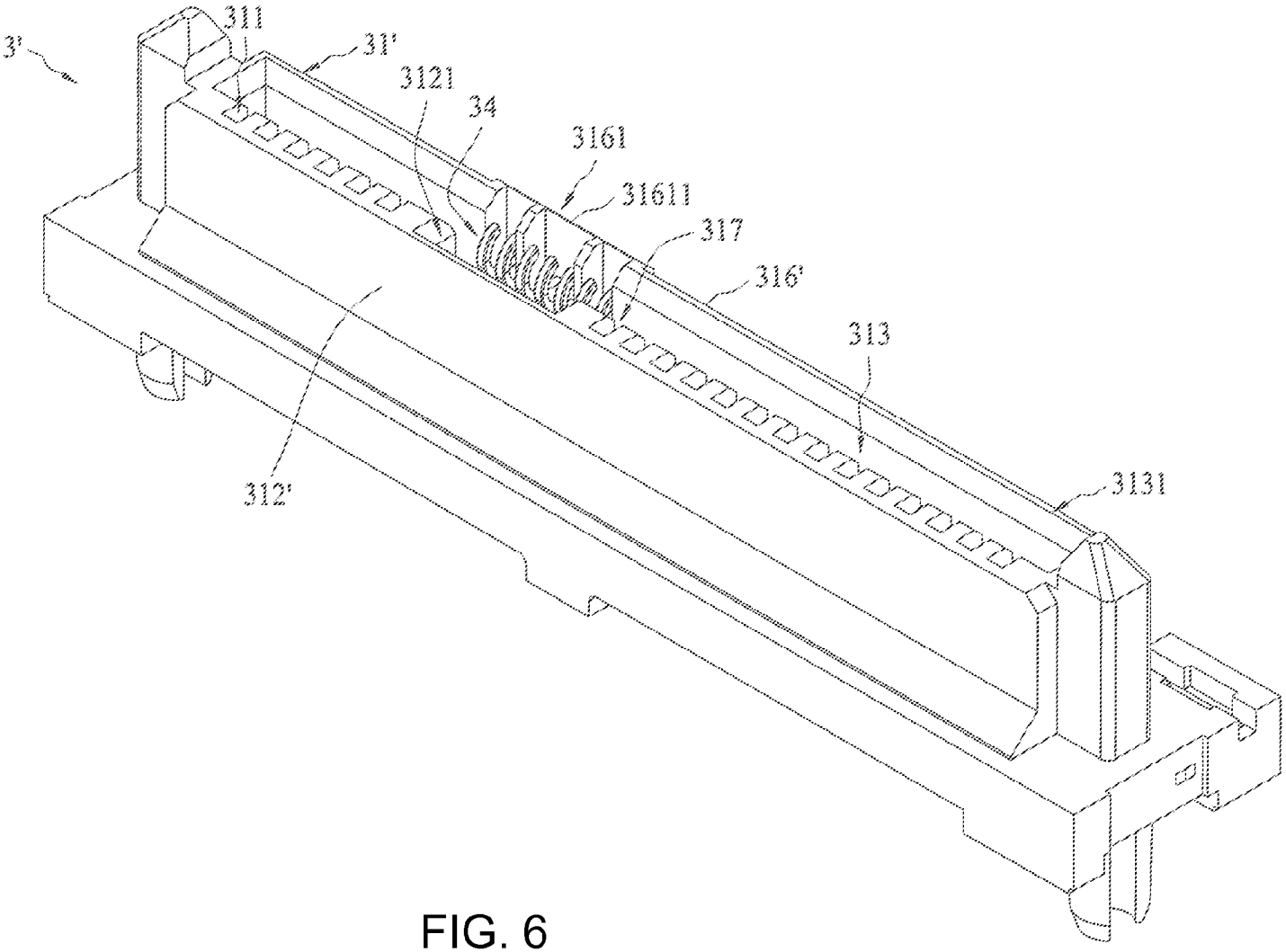
FIG. 6 is a perspective view of an embodiment of an electrical connector.
Figure 7:
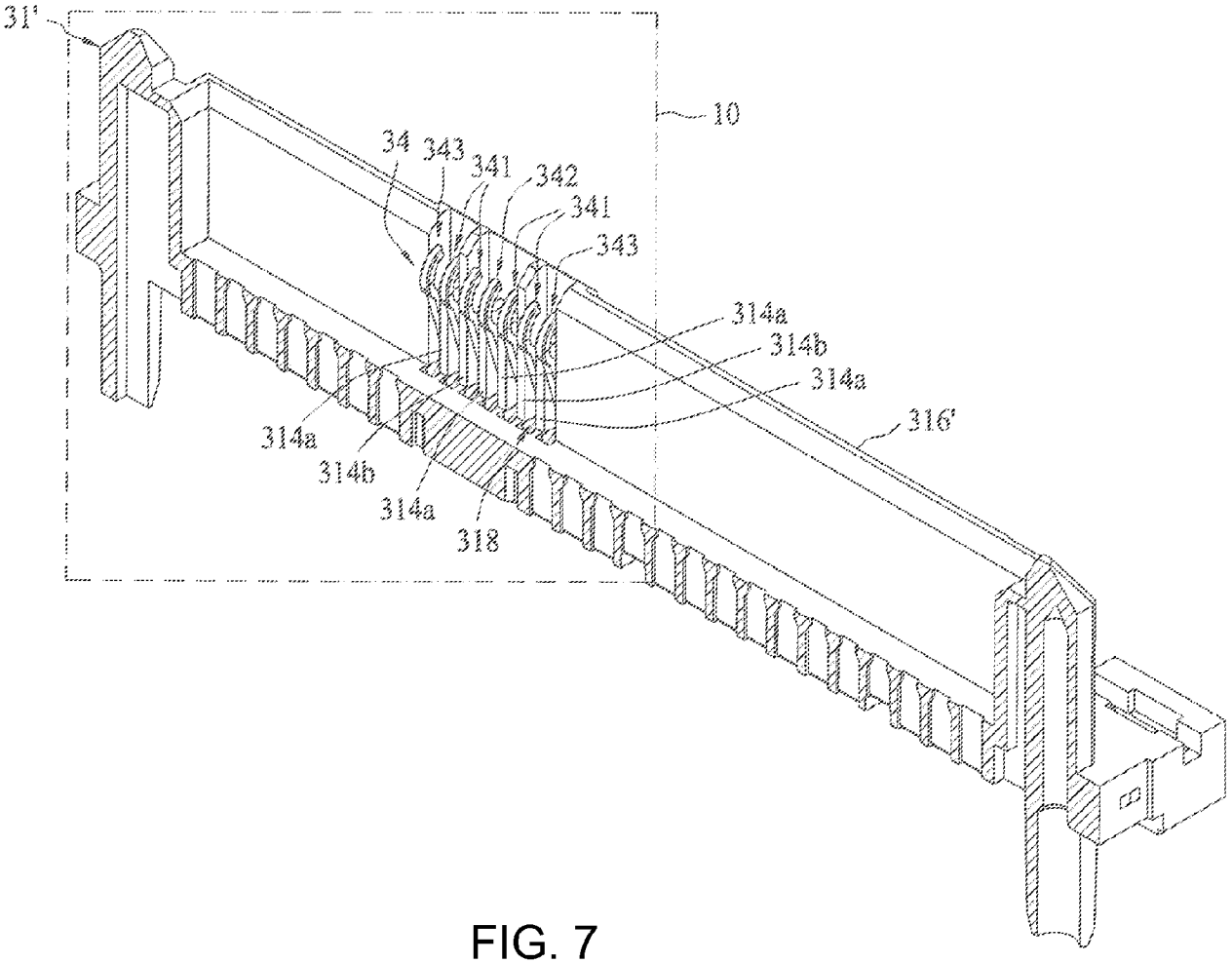
FIG. 7 is a cut away perspective view of an embodiment of an electrical connector.
Figure 8:
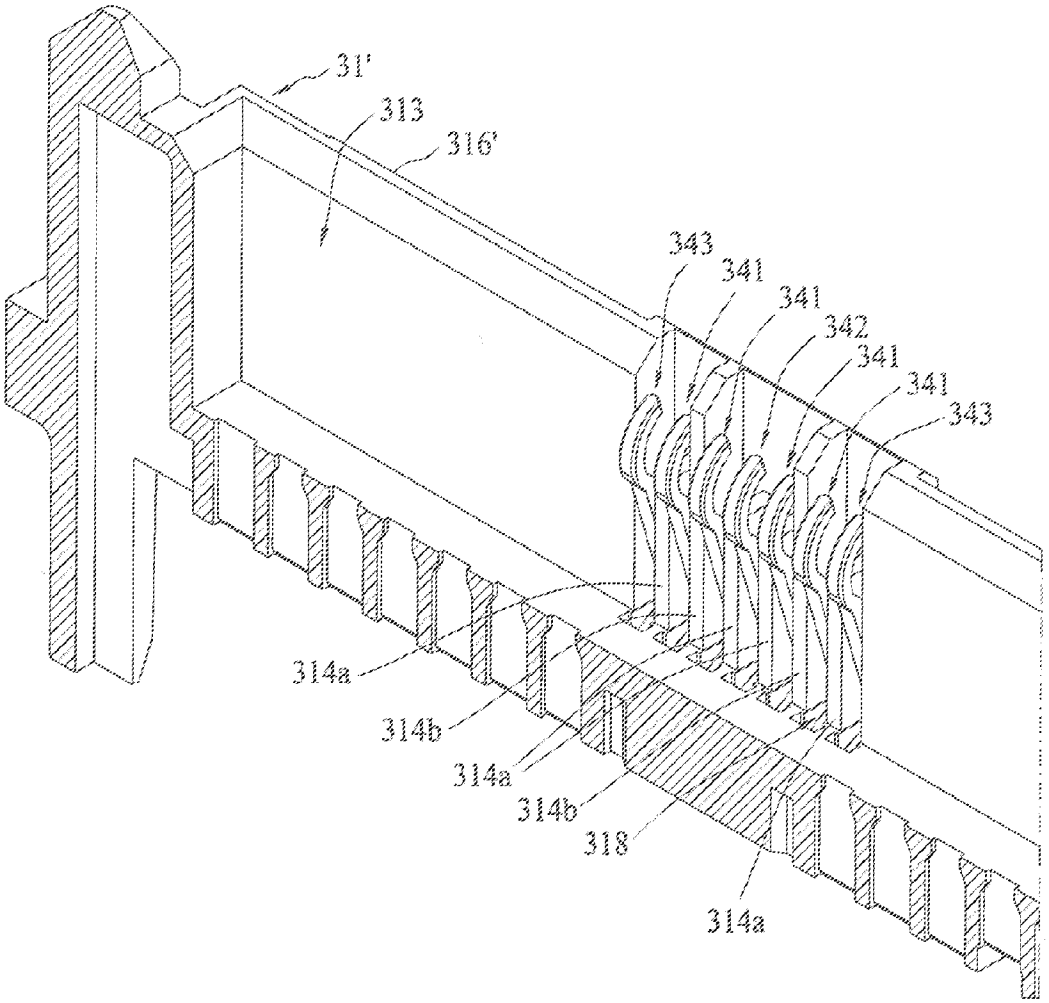
FIG. 8 is a partial enlarged perspective view of part 10 in FIG. 7.
Figure 9:
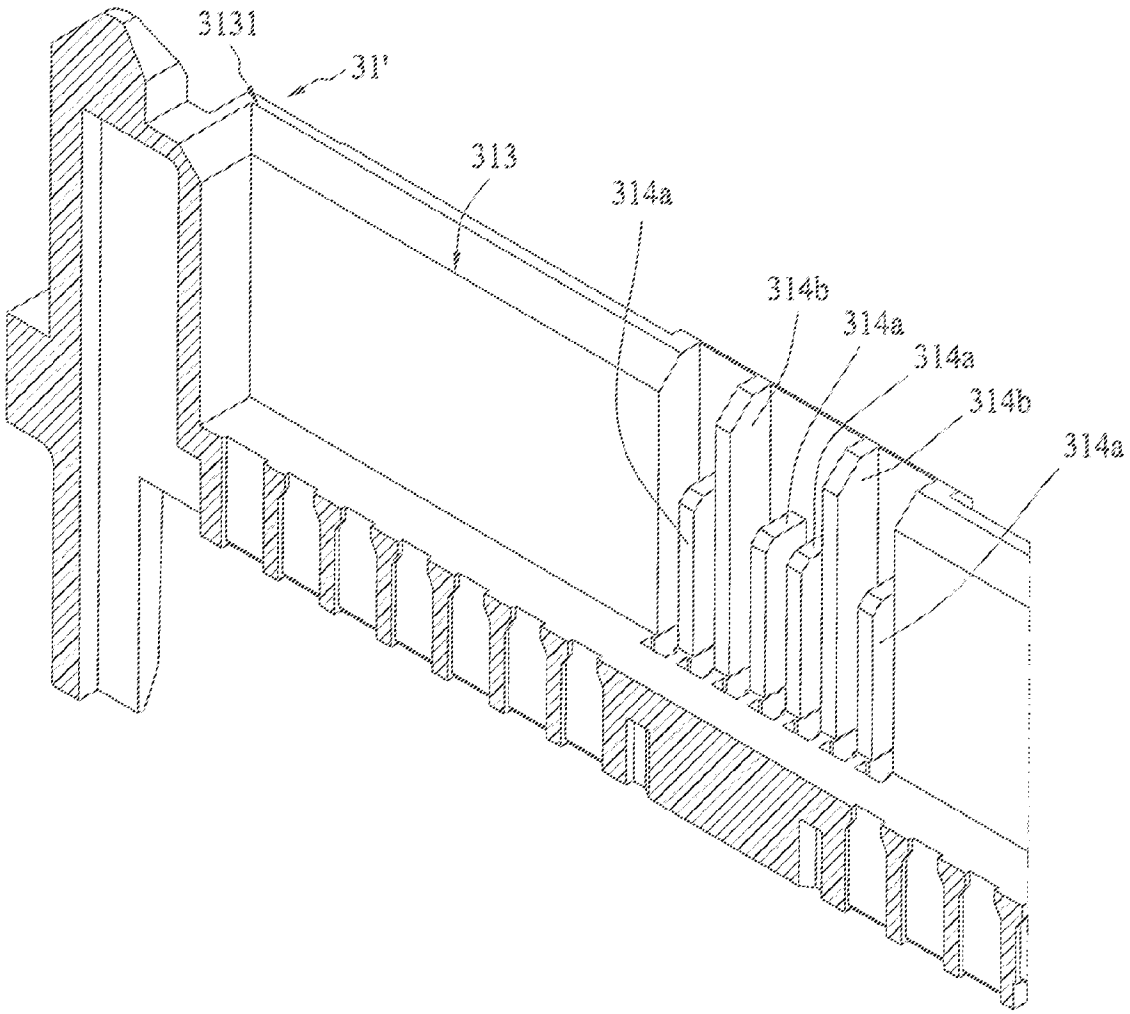
FIG. 9 illustrates a simplified view of the embodiment depicted FIG. 8.

FIG. 6 is a perspective view of an embodiment of an electrical connector 3'. FIG. 7 is a cut away view of the electrical connector 3'. FIG. 8 is a partial enlarged view of part 10 in FIG. 7. FIG. 9 illustrates spacers (314*a* and 314*b*) of the electrical connector 3' of the embodiment of the present disclosure. The electrical connector 3' of FIG. 6 is similar to the electrical connector 3 of FIG. 2, a main difference lies in design for a part of spacers on the body.

Referring to FIG. 6 and FIG. 7, the electrical connector 3' may comprise a body 31' and a plurality of terminals 34. The body 31' may be formed with a plurality of terminal grooves 318, the plurality of terminals 34 are received in the plurality of terminal grooves 318. The body 31' may comprise a side wall 316' and a slot 313, the side wall 316' may be adjacent to the slot 313, the plurality of terminal grooves 318 may be adjacent to the side wall 316'. The body 31' may comprise a plurality of spacers (314*a* and 314*b*). The spacers (314*a* and 314*b*) may be positioned on the side wall 316', and arranged alongside the slot 313 with an interval to form the terminal grooves 318. In an embodiment, the side wall 316' may comprise a section 3161, the section 3161 comprises an outer protruding portion 31611, the terminal grooves 318 are formed in the section 3161.

The plurality of terminals 34 may comprise two pairs of differential signal terminals 341 and a first ground terminal 342, the first ground terminal 342 is positioned between the two pairs of differential signal terminals 341. Referring to FIG. 8 and FIG. 9, in order to reduce crosstalk interference, the spacer 314*a* which is positioned between the each pair of differential signal terminals 341 and the first ground terminal 342 may be at least partially removed, so as to reduce the dielectric material between the each pair of differential signal terminals 341 and the first ground terminal 342, reduce dielectric constant between the each pair of differential signal terminals 341 and the first ground terminal 342, reduce capacitance between the each pair of differential signal terminals 341 and the first ground terminal 342, and maintain transmission quality of a high frequency signal.

The plurality of terminals 34 may comprise two second ground terminals 343, the two second ground terminals 343 are respectively positioned at two outer sides of the two pairs of differential signal terminals 341. Each second ground terminal 343 and the corresponding pair of differential signal terminals 341 are separated by the spacer 314*a* which is at least partially removed.

As shown in FIG. 9, the spacer 314*a* at least partially removed is removed a part of the spacer 314*a* which is adjacent to an insertion port 3131 of the slot 313. In another embodiment, the spacer 314*a* at least partially removed is removed an upper half part of the spacer 314*a*. In another embodiment, a height of the spacer 314*a*, which is in the slot 313, is not more than a half height of the spacer 314*b* which is in the slot 313.

If the side wall 316' of the body 31' is considered as a first side wall 316', the body 31' comprises a second side wall 312'. The slot 313 is positioned between the second side wall 312' and the first side wall 316'. The second side wall 312' may be formed with a plurality of first terminal grooves 311, a recessed portion 3121, and a plurality of second terminal grooves 317, the recessed portion 3121 separates the first terminal grooves 311 and the second terminal grooves 317.

If the terminal 34 is considered as a third terminal 34, the electrical connector 3' may comprise a plurality of first terminals 32 (as shown in FIG. 4) and a plurality of second terminals 33 (as shown in FIG. 4), the plurality of first terminals 32 are received in the plurality of first terminal grooves 311, and the plurality of second terminals 33 are received in the plurality of second terminal grooves 317. The plurality of first terminals 32 may connect signal lines or ground lines of the circuit board, and the plurality of second terminals 33 may connect power lines of the circuit board.

In an embodiment, the plurality of first terminals 32 may comprise two pairs of differential signal terminals 321 and a first ground terminal 322, the first ground terminal 322 is positioned between the two pairs of differential signal terminals 321. In an embodiment, the plurality of terminals 32 may further comprise two second ground terminals 323. The two second ground terminals 323 are respectively positioned at two outer sides of the two pairs of differential signal terminals 321. In an embodiment, the spacer between the first ground terminal 322 and the each pair of differential signal terminals 321 may be partially removed. In an embodiment, the spacer between at least one pair of differential signal terminals 321 and the adjacent second ground terminal 323 may be partially removed.

In an embodiment of the present disclosure, the body of the electrical connector comprises a side wall. The side wall has a plurality of spacers, the spacers form a plurality of terminal grooves to receive a plurality of terminals. The plurality of terminals comprise a ground terminal and a signal terminal. At least a part of the spacers which are positioned between the ground terminal and the signal terminal is at least partially removed, so as to reduce the dielectric material between the ground terminal and the signal terminal. This helps reduce the dielectric constant between the ground terminal and the signal terminal and reduces the capacitance between the ground terminal and the signal terminal, and the effect is to help maintain a desirable transmission quality of a high frequency signal. Since part of the side wall of the body does not need to be removed, the integrity of the side wall may be maintained and the body may maintain is original strength thereof. In addition, since part of the side wall of the body is not removed, the design avoids providing a channel for the dust or dirt to enter into the electrical connector and directly contact the terminals, and thus problems of a poor contact between the terminals, blocking or short circuit of the terminals and the like are less likely to occur.

Technical contents and technical features of the present disclosure are disclosed as above, but those skilled in the art still may make various substitutions and modifications without departing from the spirit of the present disclosure based on the teaching and disclosure of the present disclosure. Numerous other embodiments, modifications and variations within the scope and spirit of the appended claims will occur to persons of ordinary skill in the art from a review of this disclosure.

What is claimed is:

1. An electrical connector, comprising:

a body including a first side wall and second side wall that define a slot with a top surface, wherein the second side includes a first set of terminal grooves and a second set of terminals grooves and further includes a recess provided between the first and second set of terminal grooves, wherein the slot further includes a plurality of spacers that define at least one of the second terminal grooves on the second side wall or a third set of terminal grooves on the first side wall, the plurality of spacers generally extending out from the respective side wall toward the top surface and defining the corresponding set of terminal grooves, wherein the first and second terminal grooves extend to the top surface; and a plurality of terminals comprising two pairs of differential signal terminals and a first ground terminal, the first ground terminal being positioned between the two pairs of differential signal terminals, and the two pairs of differential signal terminals and the first ground terminal being received in the corresponding set of terminal grooves; wherein the spacer between each pair of differential signal terminals and the first ground terminal is partially removed so as to be shorter than other of the plurality of spacers and so as to not extend all the way to the top surface.

2. The electrical connector according to claim 1, wherein the plurality of terminals further comprise two second ground terminals, the two second ground terminals are respectively positioned at two outer sides of the two pairs of differential signal terminals and are respectively separated from the pairs of differential signal terminals by one of the plurality of spacers, wherein the spacer between the second ground terminal and the adjacent pair of differential signal terminals is partially removed so as to not extend all the way to the top surface.

3. The electrical connector according to claim 2, wherein the partially removed portion of the spacer is adjacent to an insertion port of the slot.

4. The electrical connector according to claim 1, wherein the first side wall comprises a section that includes a third set of terminal grooves, the section positioned opposite the recess, the section including an outer protruding portion.

* * * * *